US007694685B1

(12) United States Patent
Jones

(10) Patent No.: US 7,694,685 B1
(45) Date of Patent: Apr. 13, 2010

(54) AUTO IGNITING SMOKING PIPE

(76) Inventor: Mike Jones, 18723 Kenlake Pl. NE., Kenmore, WA (US) 98028

( * ) Notice: Subject to any disclaimer, the term of this patent is extended or adjusted under 35 U.S.C. 154(b) by 1116 days.

(21) Appl. No.: 11/236,344

(22) Filed: Sep. 27, 2005

(51) Int. Cl.
*A24F 3/00* (2006.01)

(52) U.S. Cl. ..... 131/185

(58) Field of Classification Search ..... 131/185
See application file for complete search history.

(56) References Cited

U.S. PATENT DOCUMENTS

| | | | | | |
|---|---|---|---|---|---|
| 2,398,695 | A | | 4/1946 | Cloutier | 131/185 |
| 2,549,726 | A | * | 4/1951 | Van Toll | 131/185 |
| 2,549,727 | A | * | 4/1951 | Van Toll | 131/185 |
| 2,578,061 | A | * | 12/1951 | Greenblatt | 131/185 |
| 2,595,534 | A | | 5/1952 | Nicholson et al. | 131/185 |
| 3,986,516 | A | | 10/1976 | Brooks | 131/185 |
| 4,223,686 | A | * | 9/1980 | Murray, Jr. | 131/173 |
| 4,223,687 | A | * | 9/1980 | Sandeen | 131/180 |
| 4,276,892 | A | | 7/1981 | Iaquinta | 131/185 |
| 5,417,227 | A | | 5/1995 | West | 131/185 |

* cited by examiner

*Primary Examiner*—Philip C Tucker
*Assistant Examiner*—Michael J Felton
(74) *Attorney, Agent, or Firm*—Dean A. Craine

(57) ABSTRACT

A smoking pipe comprising an elongated body with a bowl cavity formed on one end in which a bowl assembly is disposed. Located inside the elongated body is a gas lighter with an activation switch and flame opening located on one end. The lighter is positioned in the elongated body so that the flame opening is located adjacent to the upper bowl on the bowl assembly and its activation switch is near the lower neck section. Formed over the bowl are air openings which allow outside air to enter the bowl. Pivotally attached to the neck section on the bowl assembly is an elongated mouthpiece. The mouthpiece includes a wide head and a narrow arm component with a longitudinally aligned conduit formed therein that communicates with an air passageway formed on the bow assembly. A cam surface is formed on the head which presses against a plunger arm when the mouthpiece is rotated to a perpendicularly aligned position on the elongated body. The plunger arm is pressed against the activation switch on the lighter which creates a flame that extends into the bowl.

19 Claims, 4 Drawing Sheets

AUTO IGNITING SMOKING PIPE

BACKGROUND OF THE INVENTION

1. Field of the Invention

This invention relates to smoking pipes and more particularly, to a-smoking pipes used with tobacco or medicinal containing chemicals that require a constant ignition source for combustion.

2. Description of the Related Art

It is well known that inhalation administration is a well known method for delivering medications to the body. With some medication, inhalation administration is preferred due to its faster onset of activity and because it bypasses to gastrointestinal and hepatic systems that can destroy or deactivate some medications.

Some chemicals, such as nicotine, are natural occurring substances found in tobacco plants that are released when the plant is burned. The released chemical is distributed in the smoke that when inhaled, is absorbed through the lungs and into the body. Unfortunately, some plants are not readily combustible and require a continuous source of ignition to maintain combustion.

SUMMARY OF THE INVENTION

It is an object of the herein described invention to provide a compact, easy-to-use pipe for smoking combustible substances, such as tobacco.

It is another object of the invention to provide such a pipe that includes a built-in lighter that when activated, produces a continuous source of ignition.

It is a further object of the invention to provide such a pipe that includes an automatic ignition feature when the pipe is used.

These and other objects of the invention are met by a smoking pipe with a built-in lighter and an automatic ignition feature that produces a continuous flame for combusting smoking substance placed in the pipe's bowl assembly. The smoking pipe includes an elongated body with a front bowl cavity and a rear lighter cavity. Disposed inside the bowl cavity is a pipe bowl assembly. Disposed inside the lighter cavity is a compact propane lighter that includes a head with a flame port and a push-button switch. When the bowl assembly is disposed inside the bowl cavity, it is perpendicularly aligned with the lighter. During assembly, the lighter is placed inside the lighter cavity so that the flame port is placed adjacent to the upper bowl formed on the bowl assembly. The push-button switch is disposed adjacent to a plunger assembly located near the elongated body's bottom surface. The top of the bowl is open and adjacent to the top opening on the elongated body so that a desired amount of smoking substance may be easily packed therein by the user. Formed on the sides of the bowl are small openings which allow outside air and the flame from the lighter flame port, respectively, to enter the bowl and ignite the smoking substance during use.

Pivotally attached to the bottom portion of the elongated body is a mouthpiece. The mouthpiece is an elongated structure with a round wide head and a narrow arm. Extending longitudinally inside the mouthpiece and between the head and the arm is an air passageway.

In the preferred embodiment, the mouthpiece nests into a an elongated recessed cavity, longitudinally aligned and formed on the bottom surface of the elongated body. Formed in the head is a bore designed to receive the lower neck section on the bowl assembly when the bowl assembly is placed inside the bowl cavity. Formed on the sidewall of the lower neck is a bore that communicates with the main passageway longitudinally formed inside the bowl assembly. When the mouthpiece is perpendicularly aligned with the elongated body, and the head is placed around the neck section, the air passageway on the mouthpiece is aligned with the bore formed on the neck section. When the mouthpiece is rotated around the lower neck to a perpendicularly aligned position on the elongated body and the user places his or her mouth over the distal end of the mouthpiece and inhales, air and smoke may be drawn downward though the bowl assembly and into the air passageway in the mouthpiece.

As stated above, the pipe is used with a particular type of lighter with a push-button style activation switch. An automatic ignition means is provided that couples the pivoting movement of the mouthpiece with the activation switch on the lighter. In the preferred embodiment, the means for coupling the pivotal movement of the mouthpiece with the activation switch on the lighter is a cam surface is a cam surface formed on the wide neck on the mouthpiece and a plunger assembly located along the bottom surface of the elongated body. When the mouthpiece is rotated over the neck section to a perpendicularly aligned position on the elongated body, a plunger arm on the plunger assembly is forced inward which automatically ignites the activation switch on the lighter.

When the mouthpiece is disposed on the neck section and longitudinally aligned with the elongated handle, the air passageway on the mouthpiece is mis-aligned with the bore formed on the neck section thereby preventing the inhalation of smoke from the bowl assembly.

Formed on the bowl assembly is an alignment peg that engages the elongated body and radially locks the bowl assembly in position inside the bowl cavity.

DESCRIPTION OF THE PREFERRED EMBODIMENT(S)

Figure 1:
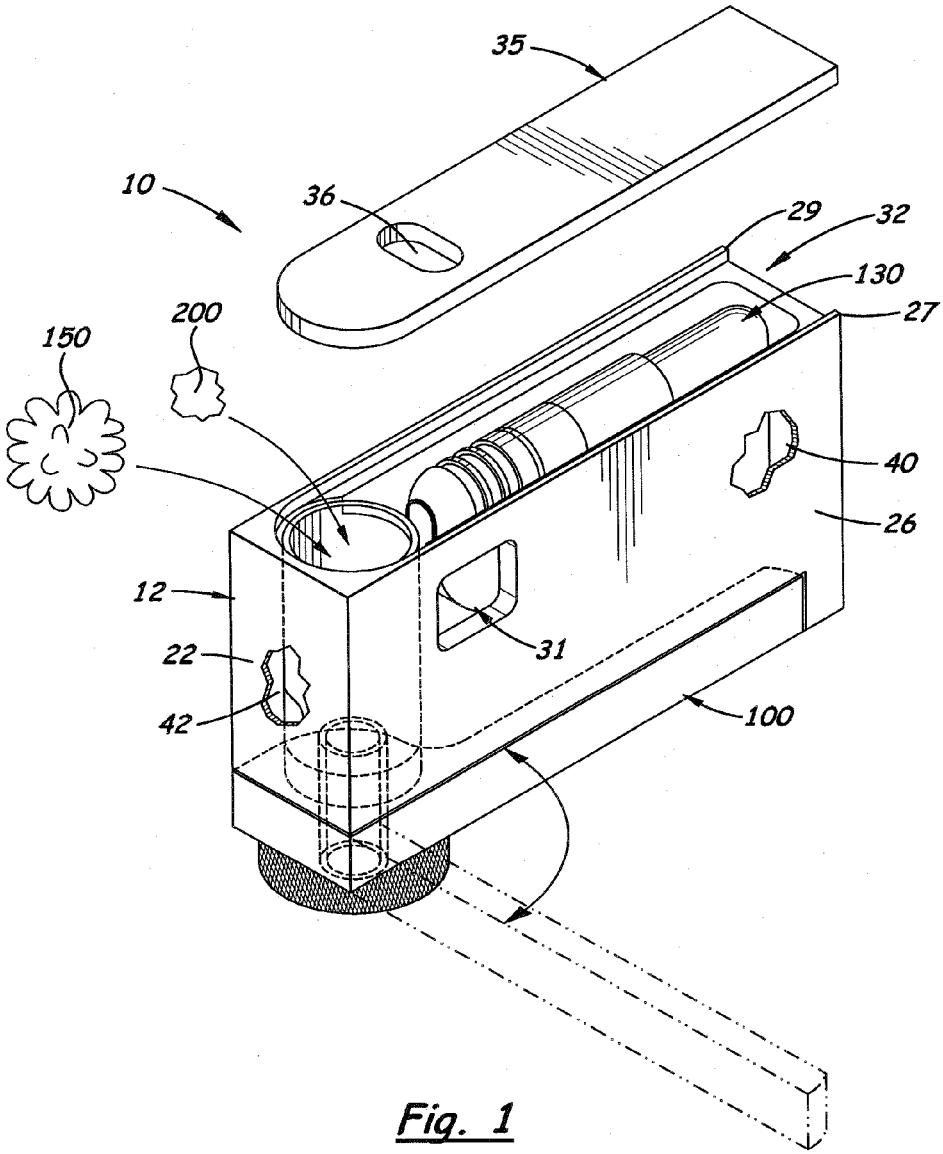
FIG. 1 is a perspective view of the auto-igniting smoking pipe disclosed herein.
Figure 2:
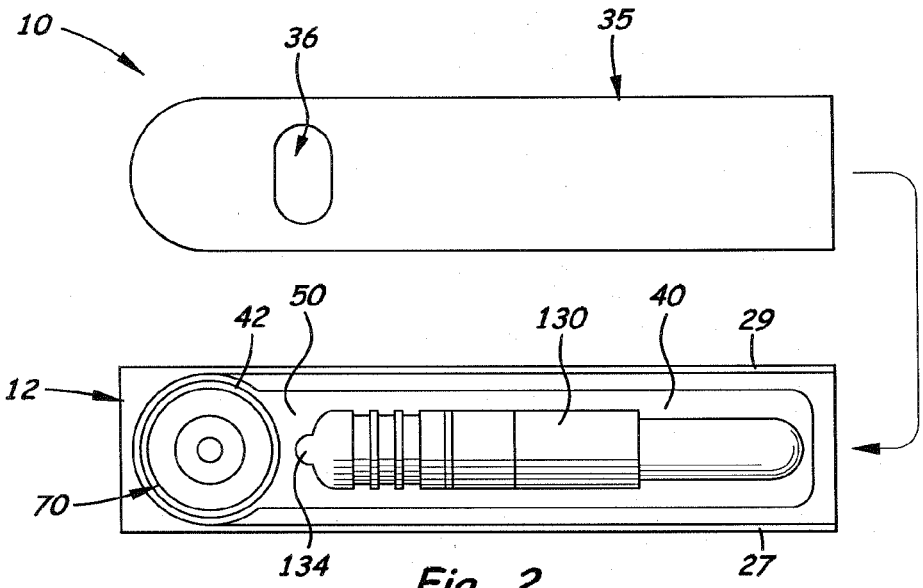
FIG. 2 is a top plan view of the smoking pipe showing the lid removed.
Figure 3:
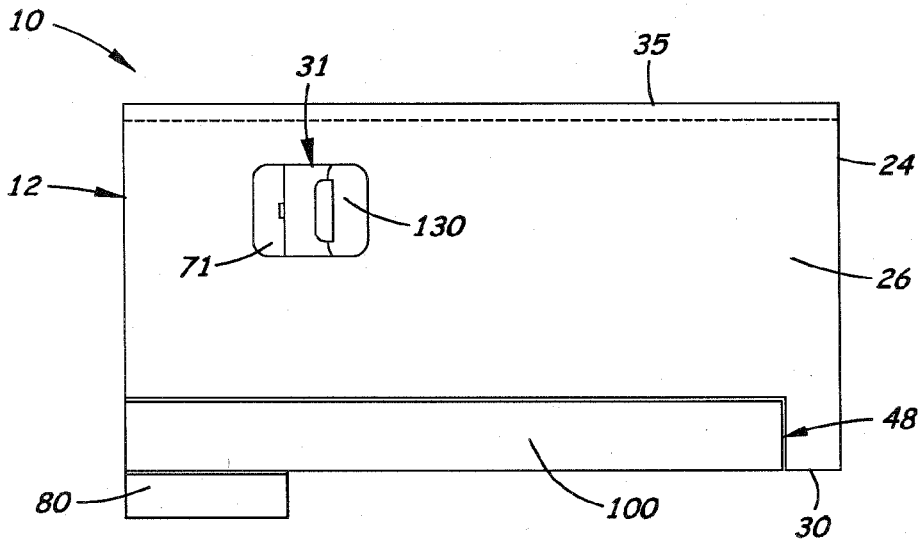
FIG. 3 is a left side elevation view of the smoking pipe.
Figure 4:
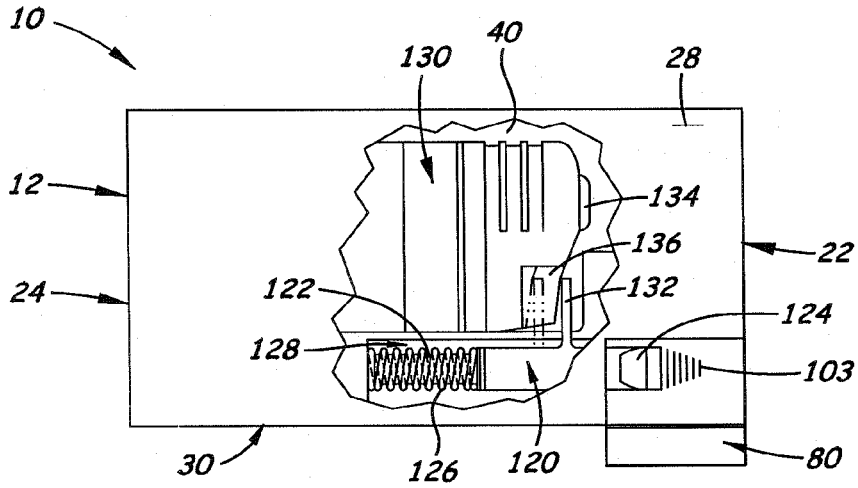
FIG. 4 is a right side elevation view of the invention.
Figure 5:
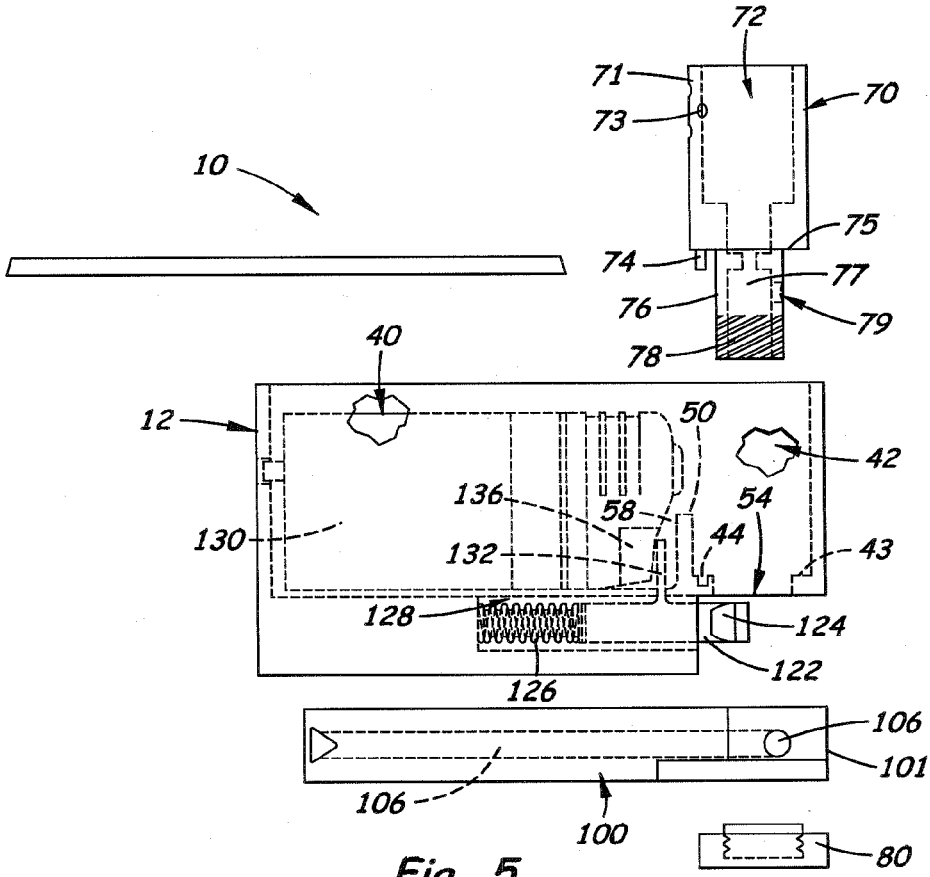
FIG. 5 is an exploded, sectional, side elevation view of the invention.
Figure 6:
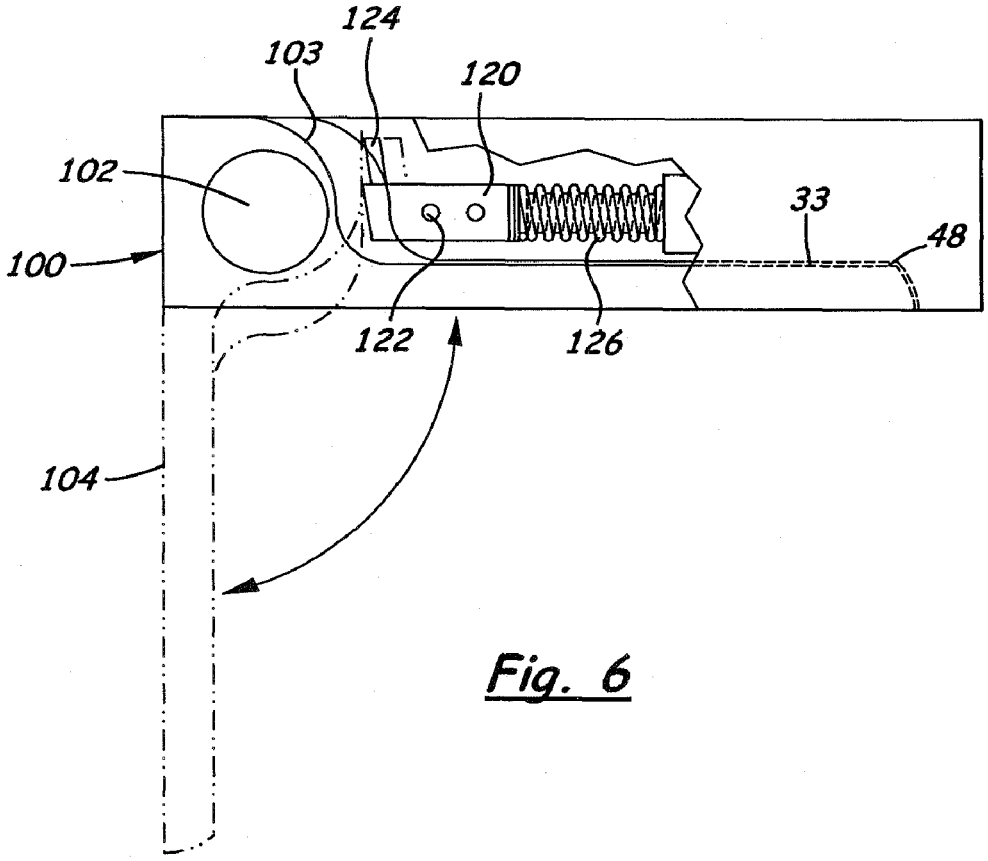
FIG. 6 is a sectional, top plan end view of the invention showing the movement of the mouthpiece.

Shown in the accompanying FIGS. 1-6 is an auto-igniting smoking pipe 10 with a built-in lighter 130 longitudinally aligned inside a lighter cavity 40 formed inside an elongated body 12. When the pipe 10 is used for smoking, the lighter 130 is automatically activated to continuously produce a flame against the upper bowl 71 formed on the bowl assembly 70 located inside a bowl cavity 42 and filled with a smoking substance 150. When smoking is discontinued, the lighter 130 is automatically de-activated thereby terminating the flame and discontinuing combustion.

The lighter cavity 40 is located behind a vertically aligned bowl cavity 42 also formed on the front section of the elongated body 12. Formed between the lighter cavity 40 and the bowl cavity 42 is a short wall partition 50 (see FIG. 2). In the preferred embodiment, the bowl cavity 42 is a cylindrical bore with a co-axially aligned hole 54 formed therein. Formed on the inside surface the wall partition 50 is an optional vertical slot 58 designed to receive a vertical peg 132 attached to a longitudinally aligned plunger arm 122. The plunger arm 122 is located inside a longitudinally aligned plunger bore 128 formed below the lighter cavity 40. Formed on the bottom surface 30 of the elongated body 12 is an L-shaped recessed area 48 in which the complimentary-shaped, elongated mouthpiece 100 resides.

The elongated body 12 is a polygon with a-parallel front and rear rectangular surfaces 22, 24, respectively, and two parallel right and left rectangular surfaces 26, 28, respectively. Formed on the elongated body 12 is a top opening 32. The elongated body 12 includes a flat bottom surface 30 perpendicularly aligned with the front and rear surfaces 22, 24.

As mentioned above, attached to the elongated body 12 and extending over the top opening 32 of the lighter cavity 40, and the bowl cavity 42 is a removable lid 35. In the preferred embodiment, the lid 35 slides between two guide rails 27, 29 formed on the upper edges of the opposite side surfaces 26, 28, respectively. Formed on the front section of the lid 35 is an air hole 36. Formed on the right surface 26 of the elongated body 20 adjacent to the bowl cavity 42 is a side air opening 31. When smoking, outside air 200 travels through the air opening 31 and air hole 36 to support combustion inside the upper bowl 71.

Disposed inside the bowl cavity 42 is a bowl assembly 70. The bowl assembly 70 includes the cylindrical-shaped, upper bowl 71 as mentioned above, and a narrow cylindrical-shaped lower neck 76. Formed between the upper bowl 71 is a cylindrical-shaped cavity 72 that communicates with a longitudinally aligned air passageway 77 formed inside the neck section 76. Formed on the rear surface of the upper bowl 71 is a plurality of holes 73 through which a frame from the lighter's burner 134 may extend to ignite the smoking substance 150 placed inside the cavity 72. Formed on the front surface of the neck 76 is a bore 79 which communicates with the air passageway 77. During use, the bore 79 is aligned with an air passageway 106 formed on the mouthpiece 100 when the mouthpiece 100 is rotated to a perpendicularly aligned position with respect to the elongated body 12. Formed near the distal end of the neck 76 are external threads 78. During assembly, a nut 80 is attached to the external threads 78 to loosely connect the mouthpiece 100 to the neck section 76 on the bowl assembly 70. Also, formed on the shoulder 75 between the upper bowl 71 and the neck section 76 is a downward extending peg 74 that fits into a complimentary-shaped hole 44 formed on a resting surface 43 located inside the bowl cavity 42. When assembled, the peg 74 is inserted into the hole 44 and used to lock the bowl assembly 70 into a fixed position inside the bowl cavity 42.

The mouthpiece 100 includes a wide head 101 and an elongated arm component 104. Formed inside the wide head 101 is a bore 102 perpendicularly aligned. Formed on the upper, inside section of the wide head 101 is a cam surface 103. The cam surface 103 is offset from the bore's center axis thereby enabling the cam surface 103 to selectively press against the plunger arm 122 longitudinally aligned inside a plunger bore 128 formed along the bottom surface of the elongated body 12.

Formed inside the mouthpiece 100 is a longitudinally aligned air passageway 106 that communicates with a bore 102 formed on the wide head 101 when assembled. The distal end of the neck section 76 extends through the bore 102 when the bowl assembly 70 is placed into the bowl cavity 42 and the mouthpiece 100 is placed inside the mouthpiece recessed cavity 48. When the nut 80 is attached to the threads 78 the mouthpiece 100 is able to rotate freely from a longitudinally aligned position to a perpendicularly aligned position over the distal end of the neck 76.

The plunder arm 122 is part of a plunger assembly 120 used to automatically activate the lighter and ignite the smoking substance when the mouthpiece 100 is moved to a perpendicularly aligned position on the elongated body. Formed on the distal end of the arm 122 is a contact head 124. Disposed around the plunger arm 122 is a spring 126 that forces the plunger arm 122 in an outward position from the plunger bore 128.

The cam surface 103 and the contact head 124 on the plunger arm 122 act as an automatic lighting feature that couples the movement of the mouthpiece 100 to the activation switch 136 on the lighter 130 so that the lighter 130 automatically ignites when the mouthpiece 100 is moved to a perpendicularly aligned position. The contact head 124 is pressed into a recessed surface formed on a lower wall formed on the bottom surface 30 of the elongated body 20. During operation, the contact head 124 presses against the cam surface 103 on the mouthpiece 100. When the mouthpiece 100 is rotated, the plunger arm 122 presses the vertical peg 132 attached to the plunger arm 122 against the activation switch 136 on the lighter 130 when the plunger arm 122 is forced inward by the mouthpiece 100.

The lighter 130 is designed so that when the activation switch 136 is pressed, a flame is automatically produced that extends into the holes 73 formed on the rear surface of the upper bowl 71. When the mouthpiece 100 is rotated to a longitudinally aligned position, the arm plunger 122 is forced outward by the spring 126, which automatically de-activates the switch 136 and discontinues the flame.

During use, the lid 35 is removed or slid to an opened position on the elongated body 12 so that the smoking substance 150 may be easily packed into the upper bowl 71 by the user. The lid 35 is re-attached or moved to a closed position. The mouthpiece 100 is then rotated to a perpendicularly aligned position with respect to the elongated body 12 thereby activating the lighter 130. The flame from the lighter 130 extends into the upper bowl 71 to burn the smoking substance 150. Outside air 200 enters the upper bowl 71 through holes 31, 73 and travels down the neck 76 through the mouthpiece 100 and into the user's mouth.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A smoking pipe, comprising:

a. an elongated body including an inside front bowl cavity, an inside rear lighter cavity, said front bowl cavity including a lower bore formed therein;

b. a bowl assembly disposed inside said front bowl cavity, said bowl assembly including an upper bowl and a lower narrow neck section, said neck section being sufficient in length to extend through said lower bore formed on said elongated body when said bowl assembly is longitudinally aligned inside said bowl cavity, said upper bowl including an upper top opening enabling a smoking substance to be placed inside said upper bowl, and a longitudinally aligned smoke passageway that extends from said upper bowl through said lower neck, said upper bowl including at least one side flame opening, and said lower neck section including a lateral smoke exit port;

c. a lighter disposed inside said lighter cavity, said lighter including a flame port and an activation switch both located on one end of said lighter, said lighter being positioned inside said lighter cavity so that said flame port is positioned adjacent to said side flame opening on said upper bowl so that when said lighter is activated, a flame from said flame port extends into said upper bowl and combust smoking substance located therein;

d. an elongated mouthpiece pivotally attached to said neck section that extends through said bowl cavity, said mouthpiece including a wide head formed on one end and an integrally formed narrow arm component, said mouthpiece includes a longitudinally aligned, full extending conduit located therein that communicates with said smoke exit port on said lower neck of said bowl assembly when said mouthpiece is rotated over said neck section and disposed in a perpendicularly aligned position on said elongated body;

f. means for locking said bowl assembly in a fixed position inside said front bowl cavity to prevent rotation of said bowl assembly inside said front bowl cavity; and, g. means for coupling the pivotal movement of said mouthpiece on said lower neck section of said bowl assembly with said activation switch on said lighter so that said activation switch is pressed to ignite said lighter when said mouthpiece is moved to a perpendicular aligned position on said elongated body and not pressed to terminate ignition of said lighter when said mouthpiece is moved to a longitudinally aligned position on said elongated body.

2. The smoking pipe, as recited in claim 1, further including a mouthpiece recessed cavity formed on said elongated body capable of receiving said mouthpiece when said mouthpiece is longitudinally aligned on said elongated body.

3. The smoking pipe, as recited in claim 2, further including a top opening formed on said elongated body with a removable lid attached thereover providing access to said bowl cavity and said lighter cavity.

4. The smoking pipe, as recited in claim 1, wherein said means for locking said bowl assembly in a fixed position inside said bowl cavity is a pin attached to said bowl assembly that engages a bore formed on said elongated body.

5. The smoking pipe, as recited in claim 2, wherein said means for locking said bowl assembly in a fixed position inside said bowl cavity is a pin attached to said bowl assembly that engages a bore formed on said elongated body.

6. The smoking pipe, as recited in claim 4, wherein said means for locking said bowl assembly in a fixed position inside said bowl cavity is a pin attached to said bowl assembly that engages a bore formed on said elongated body.

7. The smoking pipe, as recited in claim 1, further including an air port formed on the sides of said elongated body to enable outside air to enter said bowl cavity and support combustion.

8. The smoking pipe, as recited in claim 2, further including an air port formed on the sides of said elongated body to enable outside air to enter said bowl cavity and support combustion.

9. The smoking pipe, as recited in claim 4, further including an air port formed on the sides of said elongated body to enable outside air to enter said bowl cavity and support combustion.

10. The smoking pipe, as recited in claim 5, further including an air port formed on the sides of said elongated body to enable outside air to enter said bowl cavity and support combustion.

11. The smoking pipe, as recited in claim 1, wherein said means for coupling said movement of said mouthpiece to said activation switch is a plunger arm located on said elongated body and a cam surface formed on said mouthpiece, said plunger arm including a head formed on one end, a perpendicularly aligned trigger pin extending upward inside said lighter cavity, said trigger pin capable of pressing against said activation switch on said lighter when said plunger arm is pressed inward, said cam surface capable of pressing against said head of said plunger arm when said mouthpiece is perpendicularly aligned on said elongated body to press said activation switch, said plunger arm including a biasing means to force said plunger arm outward when said mouthpiece is moved to a longitudinally aligned position on said elongated body.

12. The smoking pipe, as recited in claim 2, wherein said means for coupling said movement of said mouthpiece to said activation switch is a plunger arm located on said elongated body and a cam surface formed on said mouthpiece, said plunger arm including a head formed on one end, a perpendicularly aligned trigger pin extending upward inside said lighter cavity, said trigger pin capable of pressing against said activation switch on said lighter when said plunger arm is pressed inward, said cam surface capable of pressing against said head of said plunger arm when said mouthpiece is perpendicularly aligned on said elongated body to press said activation switch, said plunger arm including a biasing means to force said plunger arm outward when said mouthpiece is moved to a longitudinally aligned position on said elongated body.

13. The smoking pipe, as recited in claim 3, wherein said means for coupling said movement of said mouthpiece to said activation switch is a plunger arm located on said elongated body and a cam surface formed on said mouthpiece, said plunger arm including a head formed on one end, a perpendicularly aligned trigger pin extending upward inside said lighter cavity, said trigger pin capable of pressing against said activation switch on said lighter when said plunger arm is pressed inward, said cam surface capable of pressing against said head of said plunger arm when said mouthpiece is perpendicularly aligned on said elongated body to press said activation switch, said plunger arm including a biasing means to force said plunger arm outward when said mouthpiece is moved to a longitudinally aligned position on said elongated body.

14. The smoking pipe, as recited in claim 4, wherein said means for coupling said movement of said mouthpiece to said activation switch is a plunger arm located on said elongated body and a cam surface formed on said mouthpiece, said plunger arm including a head formed on one end, a perpendicularly aligned trigger pin extending upward inside said lighter cavity, said trigger pin capable of pressing against said activation switch on said lighter when said plunger arm is pressed inward, said cam surface capable of pressing against said head of said plunger arm when said mouthpiece is perpendicularly aligned on said elongated body to press said activation switch, said plunger arm including a biasing means to force said plunger arm outward when said mouthpiece is moved to a longitudinally aligned position on said elongated body.

15. The smoking pipe, as recited in claim 6, wherein said means for coupling said movement of said mouthpiece to said activation switch is a plunger arm located on said elongated body and a cam surface formed on said mouthpiece, said plunger arm including a head formed on one end, a perpendicularly aligned trigger pin extending upward inside said lighter cavity, said trigger pin capable of pressing against said activation switch on said lighter when said plunger arm is pressed inward, said cam surface capable of pressing against said head of said plunger arm when said mouthpiece is perpendicularly aligned on said elongated body to press said activation switch, said plunger arm including a biasing means to force said plunger arm outward when said mouthpiece is moved to a longitudinally aligned position on said elongated body.

16. The smoking pipe, as recited in claim 1, wherein said smoke exit port is formed on said neck section located on the opposite side of said bowl assembly from said flame opening formed on said bowl cavity.

17. A smoking pipe, comprising:

a. an elongated body including an inside front bowl cavity, an inside rear lighter cavity, said front bowl cavity including a lower bore formed therein, a mouthpiece recessed cavity formed on said elongated body;

b. a bowl assembly disposed inside said front bowl cavity, said bowl assembly including an upper bowl and a lower neck section, said lower neck section being sufficient in length to extend through said lower bore formed on said elongated body, said bowl including an upper opening enabling a smoking substance to be placed inside said bowl, and a longitudinally aligned smoke passageway formed therein, said bowl including at least one side flame opening, and a smoke exit port aligned perpendicularly on said neck section;

c. a lighter disposed inside said lighter cavity, said lighter including a flame port and an activation switch located on one end, said lighter being positioned inside said lighter cavity so that said flame port is positioned adjacent to said flame opening on said bowl so that when said lighter is activated, a flame from said flame port may extend through said flame open and combust smoking substance located inside said bowl;

d. an elongated mouthpiece pivotally attached to said neck section that extends through said lower bowl on said elongated body, said mouthpiece capable of being disposed inside said mouthpiece recessed cavity when longitudinally aligned on said elongated body, said mouthpiece including a wide head formed on one end and a narrow arm component, said mouthpiece includes a longitudinally aligned full extending conduit located therein capable of communicating with said smoke exit port on said lower neck when disposed in a perpendicularly aligned position with said elongated body and not communicating with said smoke exit port on said lower neck with moved to a longitudinally aligned position on said elongated body; and e. a means for coupling the pivotal movement of said mouthpiece on said lower neck section with said activation switch on said lighter.

18. A smoking pipe, comprising:

a. a body including an inside front bowl cavity;

b. a lighter disposed inside said body, said lighter includes a flame port, said lighter being positioned inside said lighter cavity so that said flame port is positioned adjacent to said bowl cavity so that when said lighter is activated, a flame from said flame port may combust smoking substance located inside said bowl cavity;

c. a mouthpiece pivotally attached to said body, said mouthpiece able to move from a smoking to a non-positioning position on said body, said mouthpiece includes a longitudinally aligned conduit that communicates with said bowl cavity to inhale burning smoking material placed in said bowl cavity when said mouthpiece is pivotally moved to a smoking position;

d. a switch used to activated said lighter when said mouthpiece is pivoted into a smoking position; and e. a means for coupling the pivotal movement of said mouthpiece with said activation on said lighter.

19. The smoking pipe, as recited in claim 17, further including a means for locking said bowl assembly in a fixed position on said elongate body.

* * * * *